US008478142B2

(12) United States Patent
Oh

(10) Patent No.: US 8,478,142 B2
(45) Date of Patent: Jul. 2, 2013

(54) IMAGE FORMING APPARATUS AND TONER SENSOR STATUS SENSING METHOD THEREOF AND DETERMINATION OF AGITATOR ABNORMALITY

(75) Inventor: Han-sang Oh, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 483 days.

(21) Appl. No.: 11/935,580

(22) Filed: Nov. 6, 2007

(65) Prior Publication Data

US 2008/0187330 A1 Aug. 7, 2008

(30) Foreign Application Priority Data

Feb. 6, 2007 (KR) ..... 10-2007-0012398

(51) Int. Cl.
*G03G 15/08* (2006.01)

(52) U.S. Cl.
USPC ..... 399/31; 399/256

(58) Field of Classification Search
USPC ..... 399/27, 30, 31, 36, 49, 59, 60–64, 399/254, 256, 12, 13, 25
See application file for complete search history.

(56) References Cited

U.S. PATENT DOCUMENTS 5,049,938 A * 9/1991 Ueda ..... 399/29
5,107,301 A * 4/1992 Yamauchi ..... 399/59
5,151,740 A * 9/1992 Fujimoto ..... 399/59
5,689,756 A * 11/1997 Taki et al. ..... 399/33
6,567,171 B1 * 5/2003 Rushing ..... 356/432
6,947,677 B2 * 9/2005 Uyama et al. ..... 399/27
7,054,566 B2 * 5/2006 Uyama ..... 399/27
7,177,555 B2 * 2/2007 Shu et al. ..... 399/27
7,251,421 B2 * 7/2007 Yoshizuka et al. ..... 399/43
7,356,265 B2 * 4/2008 Kawai et al. ..... 399/12
7,389,060 B2 * 6/2008 Ishibashi ..... 399/30
2006/0239701 A1 10/2006 Ishibashi

FOREIGN PATENT DOCUMENTS

JP 02127674 A * 5/1990
JP 02308277 A * 12/1990
JP 03296785 A * 12/1991
JP 04221972 A * 8/1992
JP 5-216318 8/1993
JP 06095490 A * 4/1994
JP 08110734 A * 4/1996
JP 10260579 A * 9/1998

(Continued)

OTHER PUBLICATIONS

CN Office Action issued May 24, 2011 in CN Application No. 200810001763.2.

(Continued)

*Primary Examiner* — Robert Beatty
(74) *Attorney, Agent, or Firm* — Stanzione & Kim, LLP

(57) ABSTRACT

An image forming apparatus which comprises a developing unit having a toner and a developer therein, the apparatus includes a toner sensor to receive a control voltage and to generate an output voltage corresponding to a remaining amount of the toner in the developing unit, a pulse width modulator to supply the control voltage to the toner sensor corresponding to a pulse width modulation (PWM) signal and a controller to control the pulse width modulator to supply the control voltage to the toner sensor to adjust a duty ratio of the PWM signal and make the output voltage reach a target value.

7 Claims, 4 Drawing Sheets

FOREIGN PATENT DOCUMENTS

| | | | | |
|---|---|---|---|---|
| JP | 10333421 | A | * | 12/1998 |
| JP | 2000-105498 | | | 4/2000 |
| JP | 2000-132017 | | | 5/2000 |
| JP | 2002-278383 | A | | 9/2002 |
| JP | 2002-287441 | | | 10/2002 |
| JP | 2003-122202 | A | | 4/2003 |
| JP | 2003255707 | A | * | 9/2003 |
| JP | 2004-117895 | | | 4/2004 |
| JP | 2005-91941 | | | 4/2005 |
| JP | 2005157215 | A | * | 6/2005 |
| JP | 2005164901 | A | * | 6/2005 |

OTHER PUBLICATIONS

EP Search Report issued Apr. 21, 2011 in EP Application No. 08100818.7.

KR Office Action issued Jun. 23, 2011 in KR Application No. 10-2007-0012398.

Chinese Office Action issued Dec. 8, 2011 in CN Application No. 200810001763.2.

Korean Refusal Decision issued Sep. 29, 2011 in KR Application No. 10-2007-0012398.

Korean Office Action issued Jun. 23, 2011 in KR Application No. 10-2007-0012398.

Korean Office Action Issued on Apr. 13, 2012 in KR Patent Application No. 10-2011-0122063.

EP Office Action in EP Application 09100818.7 dated Aug. 17, 2012.

European Search Report in EP Application 11194641.4 dated Aug. 20, 2012.

* cited by examiner

IMAGE FORMING APPARATUS AND TONER SENSOR STATUS SENSING METHOD THEREOF AND DETERMINATION OF AGITATOR ABNORMALITY

CROSS-REFERENCE TO RELATED APPLICATIONS

This application claims priority under 35 U.S.C. §119 from Korean Patent Application No. 10-2007-0012398, filed on Feb. 6, 2007, in the Korean Intellectual Property Office, the disclosure of which is incorporated herein in its entirety by reference.

BACKGROUND OF THE INVENTION

1. Field of the Invention

Apparatuses and methods consistent with the present general inventive concept relating to an image forming apparatus and a toner sensor status sensing method thereof, and more particularly, to an image forming apparatus which adjusts a control voltage of a toner sensor, and a toner sensor status sensing method thereof.

2. Description of the Related Art

An image forming apparatus forms an image based on printing data. The image forming apparatus may form an image by a one-component developing method, i.e., only by a toner, and two-component developing method, i.e., by both a developer (carrier) and a toner. The two-component developing method is employed in an electrophotographic image forming apparatus and a multi function peripheral (MFP).

As the image forming apparatus employing the two-component developing method forms an image, a density of a toner becomes lower continuously to cause a changing of a density of a developer. To maintain the quality of a developed image, a developing unit that is mounted in the image forming apparatus requires a toner sensor that senses a density ratio of the toner and the developer.

The toner sensor of the developing unit transmits an output voltage being changed by a predetermined control voltage, and provides information on the remaining amount of the toner to the image forming apparatus. At an initial stage of being mounted in the developing unit, the toner sensor transmits the output voltage according to a reference density set by a type of the image forming apparatus.

The output voltage of the toner sensor is set during a manufacturing process of the developing unit to be transmitted according to correct reference density. Accordingly, the control voltage changing the output voltage is manually adjusted from the outside, e.g., by a jig. Once set, the control voltage cannot be adjusted again. Thus, the image forming apparatus may not sense an abnormal state of the toner sensor, e.g., the unchanged output voltage according to the density of the toner, and may not sense the abnormal state of the toner sensor and an agitator when the output voltage of the toner sensor is changed according to a rotation of the agitator of the developing unit.

SUMMARY OF THE INVENTION

The present general inventive concept provides an image forming apparatus which automatically changes a control voltage changing an output voltage of a toner sensor, simplifies a manufacturing process of a developing unit, and automatically adjusts and sets an initial reference density value of a toner sensor, and a toner sensor status sensing method thereof.

The present general inventive concept provides an image forming apparatus that can sense a malfunction of the toner sensor and the agitator included in the developing unit by detecting a level of the output voltage according to variation of the control voltage, and a toner sensor status sensing method thereof.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus which includes a developing unit having a toner and a developer therein, the apparatus including a toner sensor to receive a control voltage and to generate an output voltage corresponding to a remaining amount of the toner in the developing unit, a pulse width modulator to supply the control voltage to the toner sensor corresponding to a pulse width modulation (PWM) signal and a controller to control the pulse width modulator to supply the control voltage to the toner sensor to adjust a duty ratio of the PWM signal and to make the output voltage reach a target value.

The image forming apparatus may further include a storage unit, wherein the controller stores the duty ratio of the PWM signal in the storage unit if the output voltage reaches the target value.

The image forming apparatus may further include an informer, wherein the controller informs a user through the informer that the toner sensor is abnormal if the output voltage is equal to or less than a minimum reference value, and is not increased according to the raised duty ratio.

The controller may inform a user through the informer that the toner sensor is abnormal if the output voltage is equal to or greater than a maximum reference value, and is not decreased according to the lowered duty ratio.

The controller may adjust the duty ratio of the PWM signal if the developing unit is initially mounted in the image forming apparatus or if power of the image forming apparatus is turned on.

The developing unit may further include an agitator to agitate the toner and the developer, and the controller to detect a maximum value of the output voltage according to a rotation of the agitator, and an informer to inform a user that the toner sensor or the agitator is abnormal if the maximum value is not periodically detected.

The foregoing and/or other aspects and utilities of the present general inventive concept can be achieved by providing a toner sensor status sensing method of an image forming apparatus having a toner sensor to receive a control voltage and to generate an output voltage corresponding to a remaining amount of a toner in a developing unit, the method including calculating a target value of the output voltage, adjusting a duty ratio of a pulse width modulation (PWM) signal according to the calculated target value and supplying the control voltage to the toner sensor corresponding to the adjusted duty ratio.

The adjusting the duty ratio may include storing the duty ratio of the PWM signal if the output voltage reaches the target value.

The supplying the control voltage may further include determining whether the output voltage is increased according to the raised duty ratio if the output voltage is equal to or less than a minimum reference value and informing a user that the toner sensor is abnormal if it is determined that the output voltage is not increased.

The supplying the control voltage may further include determining whether the output voltage is decreased according to the lowered duty ratio if the output voltage is equal to or greater than a maximum reference value and informing a user that the toner sensor is abnormal if it is determined that the output voltage is not decreased.

The adjusting the duty ratio may include adjusting the duty ratio of the PWM signal if the developing unit is initially mounted in the image forming apparatus, or if power of the image forming apparatus is turned on.

The supplying the control voltage may further include detecting a maximum value of the output voltage according to a rotation of an agitator agitating the toner and the developer of the developing unit and informing a user that the toner sensor or the agitator is abnormal if the maximum value is not periodically detected.

The foregoing and/or other aspects and utilities of the present inventive concept may be achieved by providing an image forming apparatus, comprising a toner sensor to sense a density ratio of toner and developer and to generate an output voltage corresponding to the sensed density ratio and a controller to adjust a control voltage supplied to the toner sensor corresponding to the output voltage generated by the toner sensor.

The foregoing and/or other aspects and utilities of the present inventive concept may be achieved by providing an image forming apparatus, comprising an agitator to agitate toner and developer through a rotational movement, a toner sensor to sense the rotational movement of the agitator and to generate an output voltage corresponding to the rotational movement of the agitator and a controller to detect whether a maximum value of the output voltage of the toner sensor is generated and to determine whether the agitator is normal or abnormal based on whether the maximum value is detected.

The foregoing and/or other aspects and utilities of the present inventive concept may be achieved by providing a method of detecting a level of toner in an image forming apparatus, the method comprising sensing a density ratio of the toner and developer, generating an output voltage corresponding to the sensed density ratio and adjusting a control voltage supplied to the toner sensor corresponding to the output voltage generated by the toner sensor.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings of which.

DETAILED DESCRIPTION OF THE PREFERRED EMBODIMENTS

Figure 1:
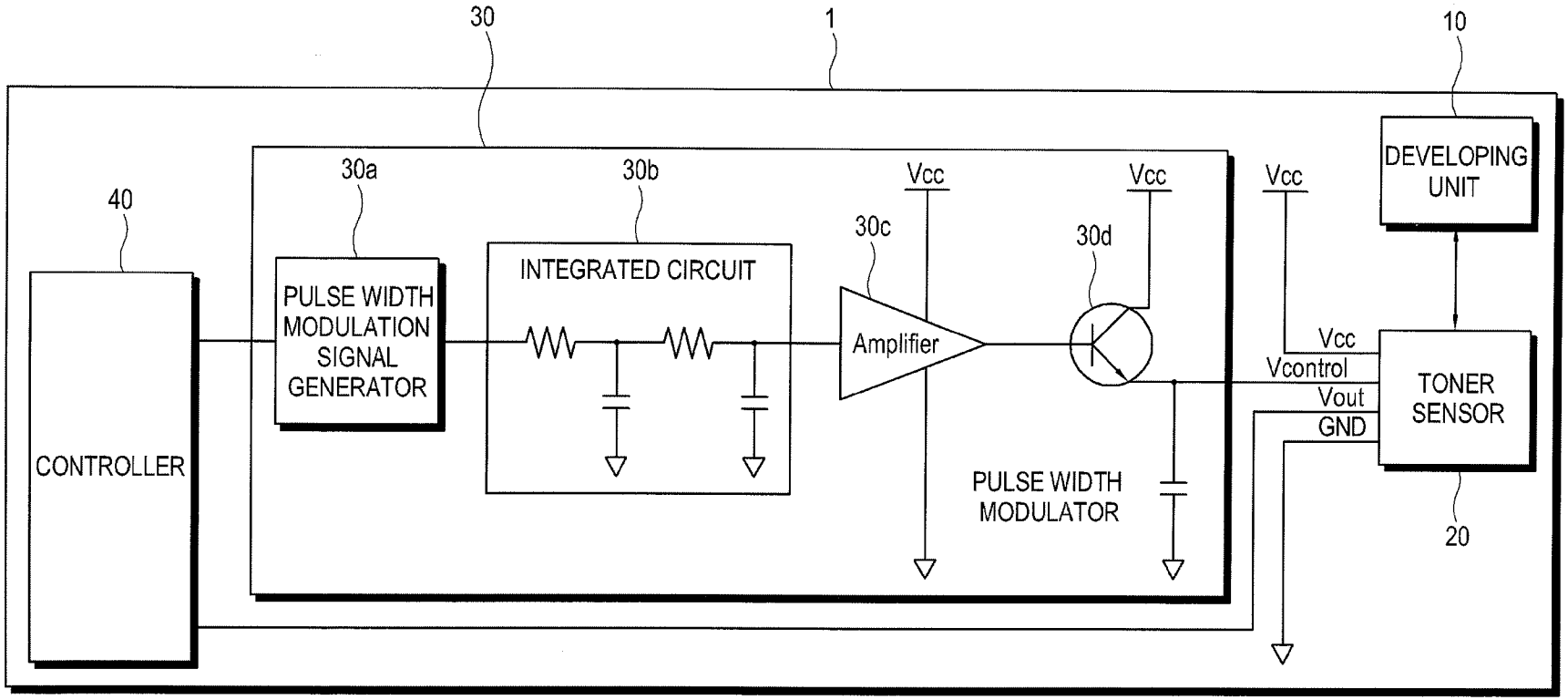
FIGS. 1 and 2 are block diagrams illustrating an image forming apparatus according to exemplary embodiments of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an image forming apparatus 1 according to an exemplary embodiment of the present general inventive concept. As illustrated therein, the image forming apparatus 1 according to this exemplary embodiment may include a developing unit 10, a toner sensor 20, a pulse width modulator 30 and a controller 40, and may be embodied by a printing apparatus performing printing to print data.

The developing unit 10 that includes a toner/carrier compartment having a toner and carrier therein and a toner supply compartment applies a developer on a photosensitive body (not illustrated) forming an electrostatic latent image with both a toner and a developer.

The toner sensor 20 receives a control voltage and senses a remaining amount of the toner in the toner/carrier compartment of the developing unit 10 by outputting an output voltage corresponding to the remaining amount of the toner on a basis of the received control voltage, and the ratio of the toner and the developer in the toner/carrier compartment of the developing unit 10. The controller 40 controls the supply of the toner from the toner supply compartment to the toner/carrier compartment based on an output signal received from the toner sensor 20.

The pulse width modulator 30 supplies the control voltage to the toner sensor 20 corresponding to a pulse width modulation (PWM) signal. The pulse width modulator 30 according to an embodiment of the present general inventive concept includes a pulse width modulation (PWM) signal generator 30*a*, an integrated circuit 30*b*, an amplifier 30*c* and a transistor 30*d*.

The PWM signal generator 30*a* generates a PWM signal to adjust a level of the control voltage according to a duty ratio supplied by the controller 40 (to be described later).

The integrated circuit 30*b* integrates the PWM signal generated by the PWM signal generator 30*a* and outputs a signal corresponding to the integrated PWM signal. The amplifier 30*c* amplifies the signal output by the integrated circuit 30*b*.

The signal amplified by the amplifier 30*c* is rectified as a direct current (DC) voltage by the transistor 30*d* to be supplied to an analog to digital (AD) converter (not illustrated). The signal is converted into a digital signal by the AD converter to be supplied to the toner sensor 20. The toner sensor 20 receives the digital signal corresponding to the control voltage.

The controller 40 controls the pulse width modulator 30 to supply the control voltage to the toner sensor 20 so that the output voltage of the toner sensor 20 reaches a target value, by adjusting a duty ratio of the PWM signal. The controller 40 according to an embodiment of the present general inventive concept may include a micro controller unit (MCU), or a PWM controller which controls generation of the PWM signal.

The controller 40 sets the duty ratio of the PWM signal as a reference duty ratio, e.g., 50%, and controls the pulse width modulator 30 to generate the PWM signal accordingly. The controller 40 supplies the control voltage to the toner sensor 20 corresponding to the signal output by the pulse width modulator 30.

If the voltage level output by the toner sensor 20 does not correspond to the target value, the controller 40 adjusts the duty ratio of the PWM signal and controls the pulse width modulator 30 to generate the PWM signal again. The target value of the output voltage refers to an output voltage having the best resolving power according to the ratio of the toner and the developer of the developing unit 10 such as, for example, an output voltage of 2.5V.

If the output voltage output by the toner sensor 20 is larger than the target value, the controller 40 lowers the duty ratio of the PWM signal, e.g., by 0.1%, and then controls the pulse width modulator 30 to generate the PWM signal according to the lowered duty ratio. The controller 40 supplies the control voltage to the toner sensor 20 according to the lowered PWM signal, and detects the output voltage of the toner sensor 20.

If the output voltage output by the toner sensor 20 is smaller than the target value, the controller 40 raises the duty ratio of the PWM signal, e.g., by 0.1%, and then controls the pulse width modulator 30 to generate the PWM signal according to the raised duty ratio. The controller 40 supplies the control voltage to the toner sensor 20 according to the raised PWM signal, and detects the output voltage of the toner sensor 20.

The controller 40 repeats the foregoing processes and controls the output voltage output by the toner sensor 20 to reach the target value.

The foregoing operations of the controller 40 may be performed when the developing unit 10 is initially mounted or power of the image forming apparatus 1 is turned on.

Thus, the initial reference density value of the toner sensor 20 may be automatically adjusted or set.

Figure 2:
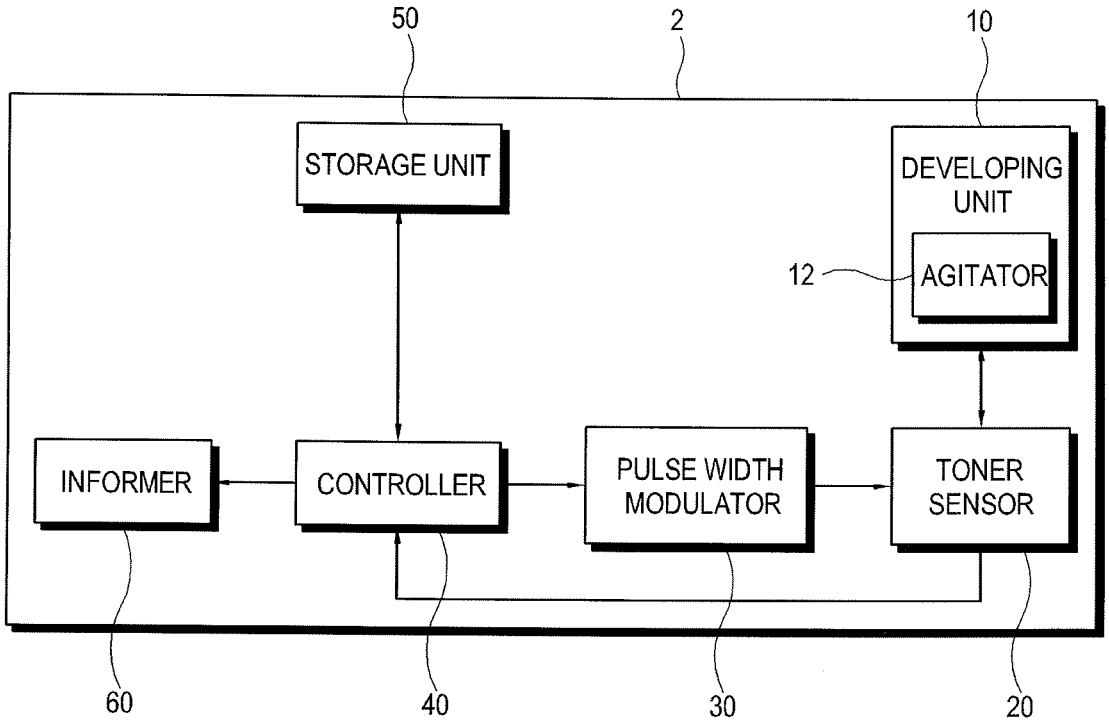

Hereinafter, an image forming apparatus 2 according to the other exemplary embodiment of the present general inventive concept will be described with reference to FIG. 2.

As illustrated therein, the image forming apparatus 2 according to the other exemplary embodiment of the present general inventive concept further includes a storage unit 50 and an informer 60. Other elements of the image forming apparatus 2 according to the present embodiment are the same as those described in the previous exemplary embodiment of the present general inventive concept. Thus, the detailed description will be avoided here.

The storage unit 50 stores a duty ratio of a pulse width modulation (PWM) signal if an output voltage of a toner sensor 20 reaches a target value. The storage unit 50 according to an embodiment of the present general inventive concept may include a flash memory, and the storage unit 50 may be provided in a developing unit 10.

The informer 60 informs an abnormal state of the toner sensor 20 to a user. The informer 60 according to an embodiment of the present general inventive concept may include a display unit such as a light emitting diode (LED), or a liquid crystal display (LCD). The informer 60 may be variously provided including a sound output unit to output a sound signal, as long as it informs the state of the toner sensor 20 to a user.

The controller 40 controls the pulse width modulator 30 to generate a PWM signal according to the duty ratio of the PWM signal stored in the storage unit 50, and detects the output voltage output by the toner sensor 20 according to the generated PWM signal.

If the detected output voltage is equal to or less than a minimum reference value, e.g., 0V, the controller 40 raises the duty ratio of the PWM signal by 10% and detects the output voltage output by the toner sensor 20. The level of the control voltage input to the toner sensor 20 is proportional to that of the output voltage output by the toner sensor 20. If the level of the detected output voltage is not increased according to the raised duty ratio of the PWM signal, the controller 40 informs a user through the informer 60 that the toner sensor 20 is abnormal.

If the detected output voltage is equal to or greater than a maximum reference value, e.g. 3.3V, the controller 40 lowers the duty ratio of the PWM signal by 10% and detects the output voltage output by the toner sensor 20. If the level of the detected output voltage is not decreased according to the lowered duty ratio of the PWM signal, the controller 40 informs a user through the informer 60 that the toner sensor 20 is abnormal.

The developing unit 10 may further include an agitator 12 to agitate the toner and the developer. The controller 40 detects a maximum value of the output voltage output by the toner sensor 20 according to a rotation of the agitator 12, and informs a user through the informer 60 that the agitator 12 is abnormal if the maximum value is not periodically detected.

If the maximum value of the output voltage output by the toner sensor 20 according to the rotation of the agitator 12 of the developing unit 10 is detected according to a rotation period of the agitator 12, e.g., every 216 ms, the controller 40 determines that the toner sensor 20 and the agitator 12 are normal.

If the maximum value of the output voltage output by the toner sensor 20 is detected faster than the rotation period of the agitator 12 or if the maximum value of the output voltage is not detected at all, the controller 40 determines that the toner sensor 20 is abnormal and informs the abnormal state of the toner sensor 20 to a user through the informer 60. In a state that it is determined that the toner sensor 20 operates normally, if the maximum value of the output voltage output by the toner sensor 20 is detected slower than the rotation period of the agitator 12 or if the maximum value of the output voltage is not detected at all, the controller 40 informs a user through the informer 60 that the rotation of the agitator 12 is abnormal.

Figure 3:
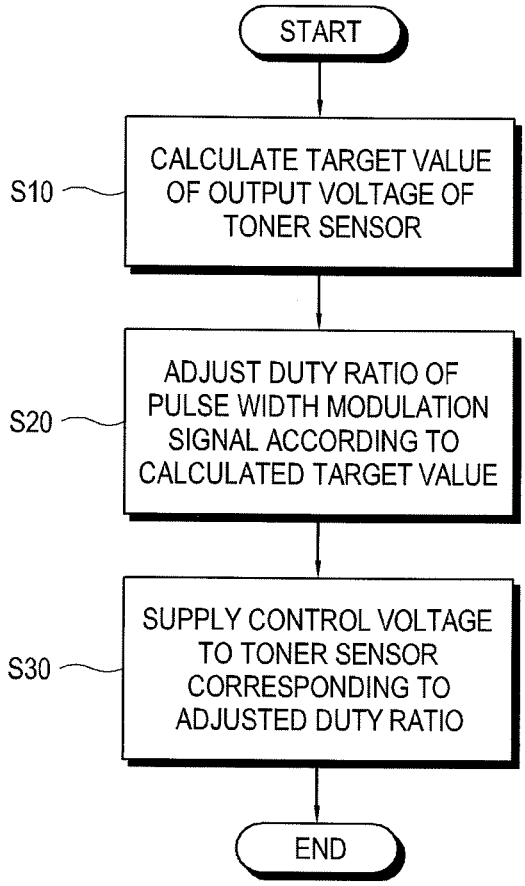
FIGS. 3 and 4 are flowcharts that illustrate a toner sensor status sensing method of the image forming apparatus according to exemplary embodiments of the present general inventive concept.

Hereinafter, a toner sensor status sensing method of the image forming apparatus 1 according to the present exemplary embodiment will be described with reference to FIG. 3.

First, the controller 40 calculates the target value of the output voltage output by the toner sensor 20 (operation S10). Here, the target value of the output voltage refers to the output voltage having the best resolving power according to the ratio between the toner and the developer of the developing unit 10 such as, for example, a voltage level of 2.5V.

The controller 40 controls the pulse width modulator 30 to adjust the duty ratio of the PWM signal according to the target value calculated at operation S10 (operation S20). If the output voltage of the toner sensor 20 reaches the target value, the controller 40 may store the duty ratio of the PWM signal in the storage unit 50. The operation S20 may be performed when the developing unit 10 is initially mounted in the image forming apparatus 1 or power of the image forming apparatus 1 is turned on.

The controller 40 supplies the control voltage to the toner sensor 20 corresponding to the duty ratio adjusted at operation S20 (operation S30). Then, the initial reference density value of the toner sensor 20 may be automatically adjusted or set.

Figure 4:
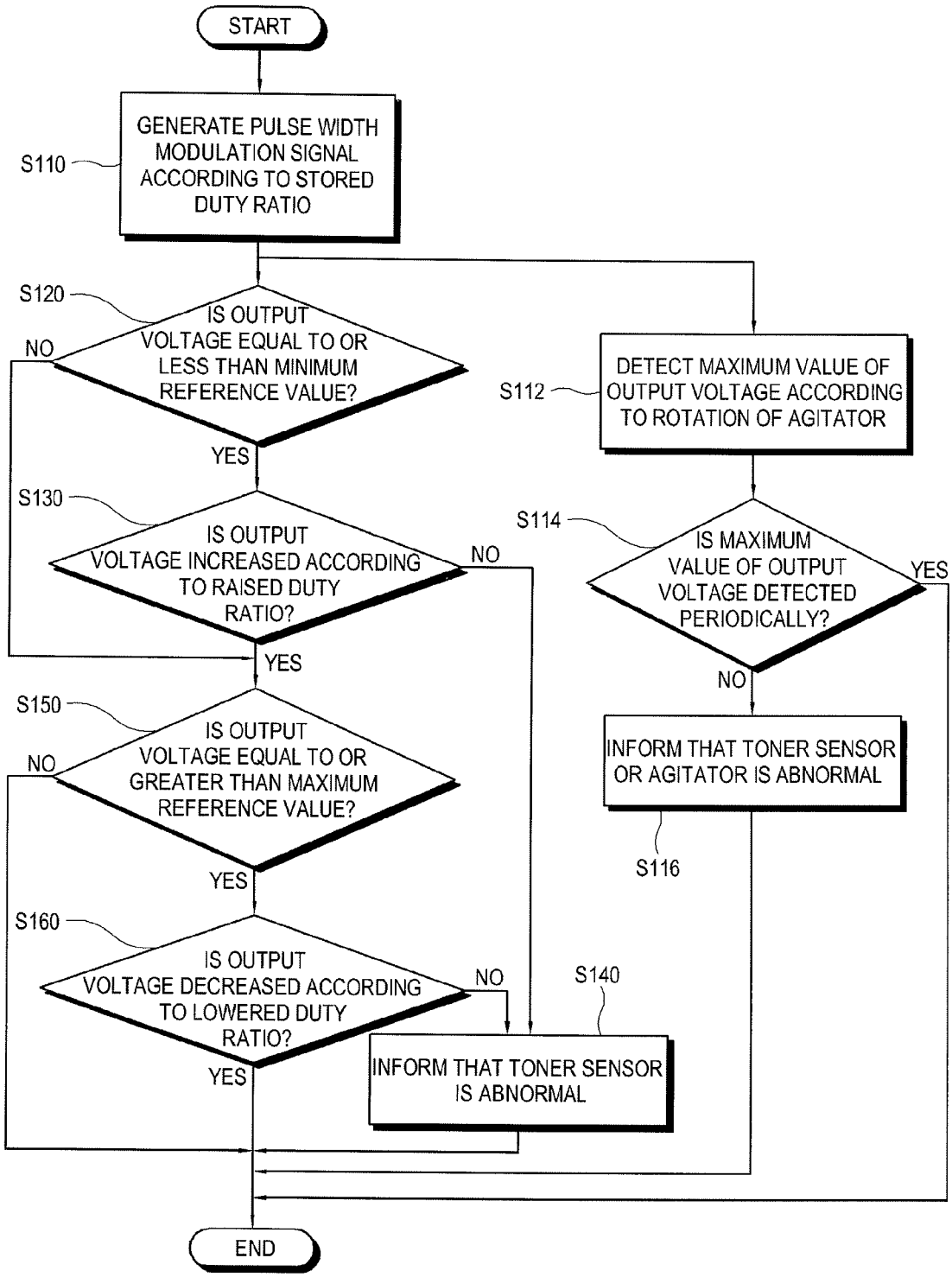

Hereinafter, a toner sensor status sensing method of the image forming apparatus 2 according to the an other exemplary embodiment of the present general inventive concept will be described with reference to FIG. 4.

First, the controller 40 controls the pulse width modulator 30 to generate the PWM signal according to the duty ratio of the PWM signal stored in the storage unit 50 (operation S110). The controller 40 determines whether the output voltage output by the toner sensor 20 is equal to or less than the minimum reference value (operation S120).

If the output voltage is equal to or less than the minimum reference value, e.g., 0V at operation S120, the controller 40 raises the duty ratio of the PWM signal by 10% and determines whether the output voltage output by the toner sensor 20 is increased accordingly (operation S130). If the output voltage output by the toner sensor 20 is not increased at operation S130, the controller 40 informs a user through the informer 60 that the toner sensor is abnormal (operation S140).

The controller 40 determines whether the output voltage is equal to or greater than the maximum reference value, e.g., 3.3V (operation S150). If the output voltage is equal to or greater than the maximum reference value at operation S150, the controller 40 lowers the duty ratio of the PWM signal by 10% and determines whether the output voltage output by the toner sensor 20 is decreased accordingly (operation S160). If the output voltage of the toner sensor 20 is not decreased at operation S160, the controller 40 informs a user through the informer 60 that the toner sensor 20 is abnormal (operation S140).

After the operation S110 is performed, the controller 40 detects the maximum value of the output voltage output by the toner sensor 20 according to the rotation of the agitator 12 agitating the toner and the developer (operation S112). The controller 40 determines whether the maximum value of the output voltage is periodically detected (operation S114). If the maximum value of the output voltage is not periodically detected, the controller 40 informs a user through the informer 60 that the toner sensor 20 or the agitator 12 is abnormal (operation S116).

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, various embodiments of the present general inventive concept provides an image forming apparatus which automatically changes a control voltage adjusting an output voltage of a toner sensor, simplifies a manufacturing process of a developing unit and automatically adjusts and sets an initial reference density value of a toner sensor, and a toner sensor status sensing method thereof.

Also, various embodiments of the present general inventive concept provides an image forming apparatus which detects an output voltage according to various control voltages and detects whether a toner sensor and an agitator of a developing unit are operating normally, and a toner sensor status sensing method thereof.

Although various exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus comprising:

a control unit to generate a control signal;

a developing unit including a toner/carrier compartment having toner and carrier therein and a toner supply compartment, the developing unit including a toner/carrier ratio sensor to receive the control signal and to generate an output signal corresponding to a toner/carrier ratio in the toner/carrier compartment of the developing unit;

when an unused developing unit having an initial toner/carrier ratio of toner/carrier in the toner/carrier compartment is newly installed in the image forming apparatus, the control unit determines a value of the control signal which causes the toner/carrier ratio sensor of the developing unit to generate the output signal which is within a target value range corresponding to the initial toner/carrier ratio of toner/carrier in the toner/carrier compartment;

a memory unit in the developing unit to store information from the control unit relating to the determined value of the control signal; and after the value of the control signal is determined and at least a portion of the toner in the toner/carrier compartment of the developing unit is consumed by the image forming apparatus, the control unit outputs the control signal having the determined value to the toner/carrier ratio sensor based on the information stored in the memory unit of the developing unit, which causes the toner/carrier ratio sensor of the developing unit to output an output signal corresponding to a changed toner/carrier ratio of toner/carrier in the toner/carrier compartment of the developing unit to the control unit, and the control unit controls supply of toner from the toner supply compartment to the toner/carrier compartment based on the output signal received from the toner/carrier ratio sensor, wherein the control unit determines whether an agitator to agitate the toner in the developing unit is normal or abnormal based on a detected periodic fluctuation of an output voltage of the toner/carrier ratio sensor, where the agitator is abnormal when a predetermined voltage is not periodically detected with the detected periodic fluctuation of the output voltage of the toner/carrier ratio sensor.

2. The image forming apparatus of claim 1, wherein the control unit comprises:

a pulse width modulator to supply the control signal to the toner/carrier ratio sensor corresponding to a pulse width modulation (PWM) signal; and a controller to control the pulse width modulator to supply the control signal to the toner/carrier ratio sensor, wherein, when the unused developing unit is newly installed in the image forming apparatus, the controller determines a duty ratio of the PWM signal so that the output voltage generated by the toner/carrier ratio sensor included in the developing unit is within the target value range, wherein the controller stores the determined duty ratio of the PWM signal in the memory unit of the developing unit, wherein, after the duty ratio of the PWM signal is determined and at least a portion of the toner in the toner/carrier compartment of the developing unit is consumed by the image forming apparatus, the controller outputs the determined duty ratio of the PWM signal to the pulse width modulator, which causes the pulse width modulator to generate and supply the control signal to the toner/ carrier ratio sensor included in the developing unit, which causes the toner/carrier ratio sensor to output the output signal corresponding to a changed toner/carrier ratio in the developing unit to the controller.

3. An image forming apparatus comprising:

a control unit to generate a control signal;

a developing unit having toner and carrier therein, the developing unit including a toner/carrier ratio sensor to receive the control signal and to generate an output signal corresponding to a toner/carrier ratio in the developing unit;

a toner supply unit;

when an unused developing unit having an initial toner/carrier ratio is newly installed in the image forming apparatus, the control unit determines a value of the control signal which causes the toner/carrier ratio sensor of the developing unit to generate the output signal which is within a target value range corresponding to the initial toner/carrier ratio;

a memory unit in the developing unit to store information from the control unit relating to the determined value of the control signal; and after the value of the control signal is determined and at least a portion of the toner in the developing unit is consumed by the image forming apparatus, the control unit outputs the determined value of the control signal to the toner/carrier ratio sensor based on the information stored in the memory unit of the developing unit, which causes the toner/carrier ratio sensor of the developing unit to output the output signal corresponding to a changed toner/carrier ratio in the developing unit to the control unit, and the control unit controls supply of toner from the toner supply unit to the developing unit based on the output signal received from the toner/carrier ratio sensor, wherein the control unit determines whether an agitator to agitate the toner in the developing unit is normal or abnormal based on a detected periodic fluctuation of an output voltage of the toner/carrier ratio sensor, where the agitator is abnormal when a predetermined voltage is not periodically detected with the detected periodic fluctuation of the output voltage of the toner/carrier ratio sensor.

4. The image forming apparatus of claim 3, wherein the control unit comprises:

a pulse width modulator to supply the control signal to the toner/carrier ratio sensor corresponding to a pulse width modulation (PWM) signal; and a controller to control the pulse width modulator to supply the control signal to the toner/carrier ratio sensor, wherein, when the developing unit is newly installed in the image forming apparatus, the controller determines a duty ratio of the PWM signal so that the output voltage generated by the toner/carrier ratio sensor included in the developing unit is within the target value range, wherein the controller stores the determined duty ratio of the PWM signal in the memory unit of the developing unit, wherein, after the duty ratio of the PWM signal is determined and at least a portion of the toner in the developing unit is consumed by the image forming apparatus, the controller outputs the determined duty ratio of the PWM signal to the pulse width modulator, which causes the pulse width modulator to generate and supply the control signal to the toner/carrier ratio sensor included in the developing unit, which causes the toner/carrier ratio sensor to output the output signal corresponding to a changed toner/carrier ratio in the developing unit to the controller.

5. A developing unit for applying developer on a photosensitive body, the developing unit comprising:

an agitator to agitate toner in the developing unit;

a toner/carrier compartment including the toner and a carrier therein, the toner/carrier compartment having an initial toner/carrier ratio of toner and carrier when the developing unit is in an unused state;

a toner/carrier ratio sensor to receive an input control signal from outside the developing unit and to generate an output signal corresponding to a toner/carrier ratio in the toner/carrier compartment of the developing unit;

a toner supply compartment to contain supply toner;

a memory unit to store information relating to a value of the input control signal causing the toner/carrier ratio sensor to generate an output signal which is within a target value range corresponding to the initial toner/carrier ratio; and after at least a portion of the toner in the toner/carrier compartment of the developing unit is consumed by an image forming apparatus, the toner/carrier ratio sensor outputs an output signal corresponding to a changed toner/carrier ratio of toner/carrier in the toner/carrier compartment in response to an input control signal received from the image forming apparatus, wherein toner from the toner supply compartment is supplied to the toner/carrier compartment based on the output signal generated by the toner/carrier ratio sensor, and wherein the agitator to agitate the toner is determined to be normal or abnormal based on a detected periodic fluctuation of an output voltage of the toner/carrier ratio sensor, where the agitator is abnormal when a predetermined voltage is not periodically detected with the detected periodic fluctuation of the output voltage of the toner/carrier ratio sensor.

6. The developing unit of claim 5, wherein the input control signal corresponds to a pulse width modulation (PWM) signal, and the information stored in the memory unit corresponds to a duty ratio of the PWM signal.

7. The developing unit of claim 5, further comprising an agitator to agitate toner and carrier in the toner/carrier compartment.

* * * * *